United States Patent [19]

Powel et al.

[11] Patent Number: 4,936,523

[45] Date of Patent: Jun. 26, 1990

[54] COMPOSITE YARN CARRIER

[75] Inventors: Stephen S. Powel, 4305 Tallwood Dr., Greensboro, N.C. 27410; Robert J. Darby, 2715-A Patriot Way, Greensboro, N.C. 27408

[73] Assignees: Stephen S. Powel; Robert J. Darby, both of Greensboro, N.C.

[21] Appl. No.: 321,278

[22] Filed: Mar. 9, 1989

Related U.S. Application Data

[63] Continuation-in-part of Ser. No. 258,187, Oct. 14, 1988.

[51] Int. Cl.[5] ..... B65H 75/28

[52] U.S. Cl. ..... 242/125.1

[58] Field of Search ..... 242/125.1, 125, 125.2, 242/125.3, 118.3, 118.31, 118.32, 18 PIN, 159, 164, 165, 166, 167, 176, 177, 178, 118.6, 118.62

[56] References Cited

U.S. PATENT DOCUMENTS

| | | | |
|---|---|---|---|
| 1,991,880 | 2/1935 | Chaffin | 242/125.1 X |
| 2,837,297 | 6/1958 | Moss | 242/118.62 |
| 3,103,305 | 9/1963 | Heatherly | 242/125.1 X |
| 3,284,023 | 11/1966 | Sowell | 242/125.1 |
| 3,625,451 | 12/1971 | Anderson | 242/125.1 |
| 3,717,291 | 2/1973 | Adams et al. | 242/125.1 X |
| 3,794,260 | 2/1974 | Sowell | 242/125.1 |
| 3,971,526 | 7/1976 | Underwood | 242/118.6 |

FOREIGN PATENT DOCUMENTS

| | | | |
|---|---|---|---|
| 2463088 | 3/1981 | France | 242/125.1 |

*Primary Examiner*—Stanley N. Gilreath

*Attorney, Agent, or Firm*—Rhodes, Coats & Bennett

[57] ABSTRACT

An end cap is releasably mounted on the end of a cylindrical hollow tube to form a reusable cylindrical yarn carrier or winding tube which carries a filamentary or fibrous yarn thereon. The cylindrical hollow tube is formed predominantly of a cylindrical laminated paper tube. A rigid polymeric or metallic insert is attached to the tube adjacent at least one end. While the tube is predominantly paper, the interface between the hollow tube and the end cap is formed of a material that is rigid, incompressible, and capable of being threaded. The abutting rigid walls of the hollow tube and end cap, when assembled, define a starting groove there between. When the yarn carrier has been emptied, the end cap is loosened or separated from the hollow tube and the residual fibers or filaments vacuumed or stripped away.

12 Claims, 3 Drawing Sheets

FIG. 1
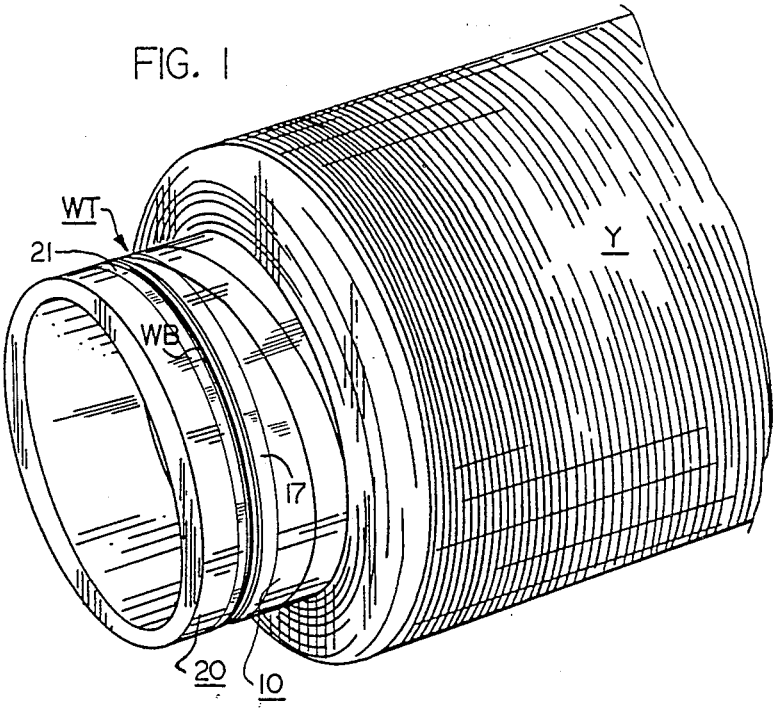
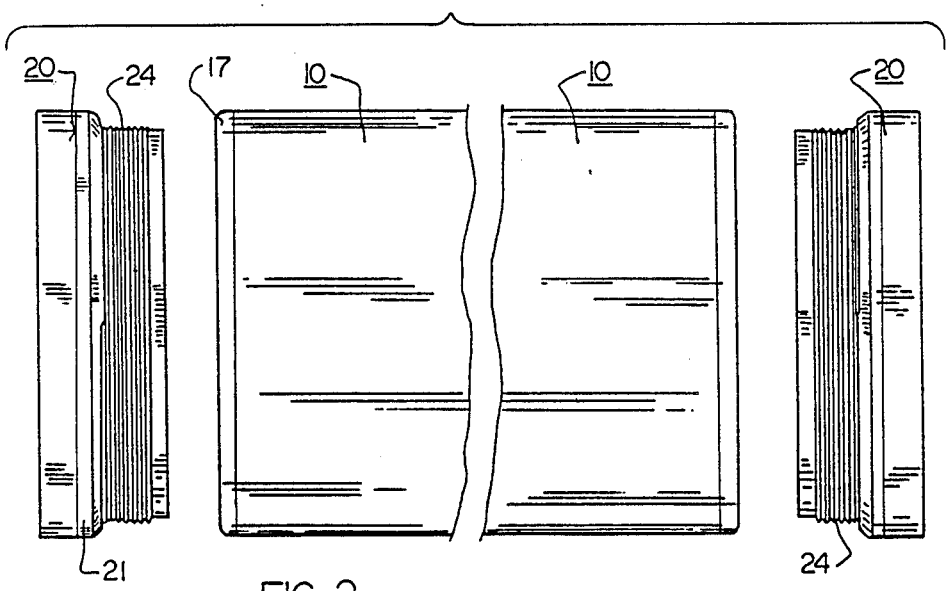
FIG. 2

FIG. 3
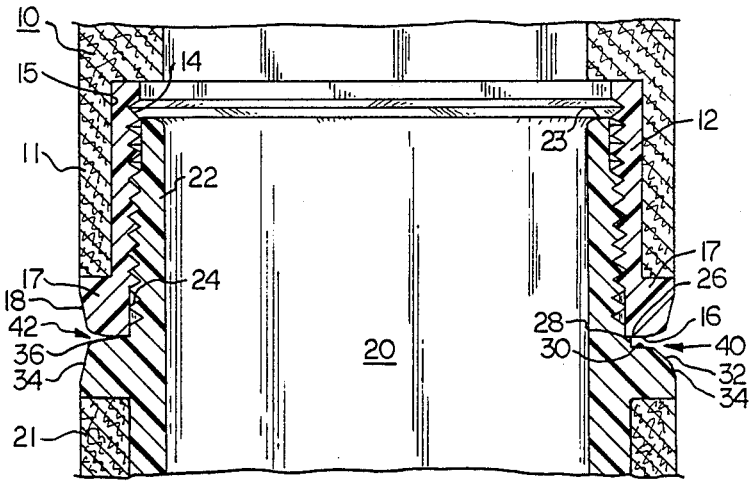
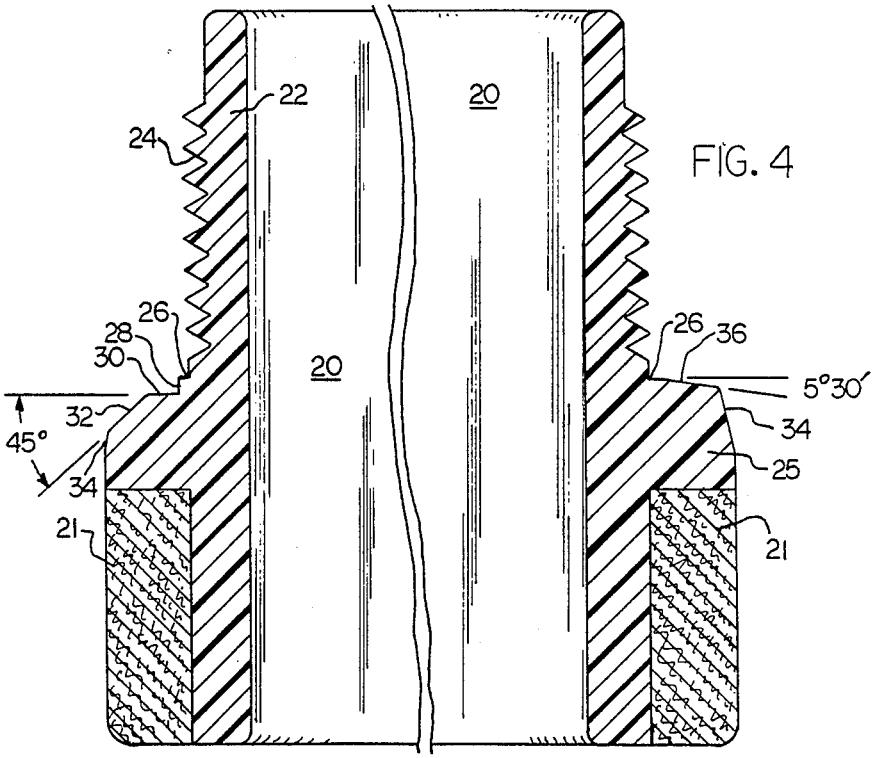
FIG. 4

COMPOSITE YARN CARRIERCROSS REFERENCE TO RELATED APPLICATIONS

This application is a continuation-in-part of our copending application Ser. No. 258,187 filed Oct. 14, 1988 entitled COMPOSITE YARN CARRIER.

BACKGROUND AND SUMMARY OF THE PRESENT INVENTION

The present invention is directed to winding tubes, and more particularly to a predominantly paper, reusable winding tube in which the fibers or filaments are more easily removed from the starting groove which carries the waste bunch once the package has been emptied.

In conventional automatic winding operations, yarn is wound onto a cylindrical laminated paper tube. One end of the paper tube includes a peripheral starting groove cut into the surface thereof (U.S. Pat. No. 3,103,305). In some systems, the starting groove is divided into two arcuate portions. The greater arcuate portion (approximately 270°) is wider and referred to as the lead-in portion, while the smaller (approximately 90°) arcuate portion (locking portion) is narrower and locks one or more of the initial strands of yarn therein during the initial few turns of the automatic winding operation. In other systems, particularly those in which fine denier yarn is being wound, the starting roove has a single configuration that is constant in cross-sectional size and shape around the entire periphery. It is also possible that the starting groove extends only partially around the periphery of the tube to latch the initial wraps of the transfer tail. These strands and the next several wraps (approximately 100) are hereinafter and commonly referred to as the "waste bunch." The completed yarn package is removed from the winding machine, and stored or shipped for further processing. During further processing, the yarn is then removed from the yarn carrier.

When the yarn is removed from the package, the last few strands of the waste bunch remain wedged in the lead-in and locking portions of the starting groove. Because of the construction of conventional paper tubes, it is very difficult to remove these remaining strands of fibrous or filamentary material. Previous attempts to remove these strands have included vacuum stripping, cutting of the strands, or a combination of both. Neither technique is satisfactory, because vacuum stripping simply does not remove all the fibrous or filamentary material. Cutting the waste bunch of these types of paper tubes generally results in damage to the surface of the paper tube making it unsuitable for further use. Such damage occurs when the laminates of the paper tube are nicked, cut, or otherwise interrupted. Use of a damaged tube at high speeds then tends to result in delamination.

As a result, conventional paper winding tubes are generally not reusable. There have been some attempts to reuse the tubes at least once by providing the starting grooves at each end of the tube, so that the tube can be reused at least once. However, often the tube is otherwise damaged during the automatic doffing and emplacement operations which substantially eliminates the reuse of the paper tubes. Conventional paper tubes are relatively expensive (25¢ to $1.00 apiece) and hundreds of thousands per year are used by typical yarn manufacturers. Thus the cost of non-reusable yarn carriers is extremely high.

Merely the replacement of paper tubes with a stronger material such as a polymeric material or aluminum is not an obvious solution. First, the starting groove cannot satisfactorily be molded or machined in the wall of a polymeric or metallic tube. Secondly, merely a change of material does not solve the problems created by the necessity to clean the waste bunch groove, as it is still not easy to vacuum the groove, and utilizing a knife will still damage the surface of the tube so that it cannot be reused. While the use of polymeric material or metallic material such as aluminum is a first step toward an improved tube, it has been found that some improved technique for cleaning of the starting groove must be provided in order to achieve a reusable winding tube.

Examples in the prior art of separable yarn carriers are illustrated in the Chaffin U.S. Patent No. 1,991,880; Moss U.S. Pat. No. 2,837,297; and Underwood U.S. Pat. No. 3,971,526. However, none of these yarn carriers are for high speed automatic winding operations or solve the problems attendant to the removal of residual fibers and filaments from a starting groove.

In our copending Ser. No. 200,939 filed May 31, 1988, now U.S. Pat. No. 4,834,314, and Ser. No. 321,038, filed Mar. 9, 1989, the tube is formed entirely of a polymeric or metallic material in two separable parts, i.e. the main hollow tube portion and a removable end cap. A starting groove is formed between the abutting end walls of the end cap and hollow tube to receive the waste bunch during the automatic winding operation. After the yarn package is emptied the end cap is removed or partially removed from the hollow tube portion, the fibers or filaments vacuumed or stripped away, and the end cap replaced. The yarn carrier is then ready for reuse.

A French Patent No. 2,463,088 to Viscosuisse, S.A. shows a somewhat related concept in which a paper tube has a friction fit (apparently plastic) slip-on ring releasably attached to the end thereof. The slip-on ring has resilient fingers that fit inside the paper tube and hold the two components in assembled relation. The confronting walls of the slip-on ring and paper tube are not peculiarly designed or of a satisfactorily rigid material to form a starting groove of of constant size and shape.

While the separable yarn carriers illustrated and described in our copending applications identified hereinabove have desirable characteristics and suggest improvements that might solve the groove cleaning problem, they also do not address certain problems and may not be acceptable as described in some existing installations. The all polymeric or metallic tube represents a significant change from the industry accepted paper tube. Obviously, the dies and/or molds for such an approach are very expensive. Further, the industry strongly prefers paper tubes for two reasons. First, from the standpoint of safety, if a paper tube fails at high speeds, it merely delaminates and no damage to equipment or personnel occurs. However, if a polymeric or metallic tube should fail, a large number of brittle pieces are released which could be dangerous to personnel or equipment. Secondly, some yarn carriers are surface driven by engaging the surface of the latch end and/or the take-off end with drive means. The drive wheels are designed to be compatible with paper and tend to scar conventional polymeric and other surfaces with a result that they may become prematured, worn and unusable.

In the broadest aspect of the present invention, it is desired to accomplish the cleaning of the starting groove by making the end cap removable, yet address the problems attendant to all polymerics or metallic tubes set forth hereinabove. A hollow paper tube and separable end cap are joined to form a starting groove at a rigid, incompressible interface therebetween. The end of the hollow paper tube is provided with a rigid insert of polymeric or metallic material. Some end caps are all polymeric, while those end caps which are engaged by drive wheels are either paper with a rigid insert or are polymeric with some type of wear-resistant surface. The inserts include mating surface configurations which form the confronting walls of the grooves and selectively effect a secure attachment of the end cap to the tube, yet allow for selective separation of the end cap and hollow tube to remove loose fibers from the starting groove. Since the hollow tube of the resulting yarn carrier is predominantly paper, and the only rigid material is the relatively small, underlying inserts which are supported peripherally, the safety concerns of the industry are fulfilled and the desirable paper surface is maintained.

In its more specific aspects the reusable winding carrier of the present invention includes a hollow, predominantly paper, tube having an outer, substantially cylindrical surface adapted to carry a filamentary or fibrous yarn thereon. The end cap includes an outer substantially cylindrical surface generally of the same radius (or in some case slightly greaster radius) as the outer surface of the hollow tube. In some embodiments, the end cap is provided with a paper or wear-resistant surface. In other embodiments where the drive wheels or bale engages only the opposite end of the winding tube during start-up, the end caps may be all polymeric. The end cap and hollow tube are each provided with mating threads or other attachment means for releasably mounting the end cap on at least one end of the hollow tube. It is possible that both ends of the hollow tube may include releasable end caps of the type described to further increase the life expectancy of the winding tube.

A starting groove is formed between the confronting walls of the hollow tube and end cap inserts which starting groove extends around a portion or all of the entire periphery of the yarn carrier. For some winding operations, the starting groove is formed with a relatively narrow locking portion extending around a minor portion (preferably approximately 90°) of the periphery of the tube and a relatively wider lead-in portion extending around the remaining portion of the periphery. The lead-in portion guides the first few turns of the waste bunch into the locking portion. The wider and narrower portions into of the starting groove are formed by molding recesses into or chamfering one or both abutting ends of the hollow tube and/or end cap during the fabrication of the components. In other winding operations, notably for the winding of finer denier yarns, the lead-in portion is unnecessary. For such operations the starting groove between the end cap and hollow tube has a constant configuration throughout.

Since the confronting walls of the end cap and hollow tube which engage each other are both of a rigid or substantially incompressible material such as a polymeric or lightweight metallic material, the configuration of the groove may be reliably formed and maintained even after repeated usage. When the operator torques the end cap against the hollow tube, the angle of the starting groove is formed and maintained. As a result, yarn cannot slip down between the engaged confronting walls. Because the material is incompressible, subsequent loosening does not occur. Further, humidity is less likely to change the groove dimensions of a rigid, incompressible material whereas paper is very sensitive to humidity. The material of the end cap and hollow tube which form the confronting walls of the groove should be the same rigid, incompressible material, because it is too expensive to form, grind and burnish a separate material. The rigid walls surrounding the groove will maintain the proper angle therebetween even after repeated usage and regardless of humidity changes. Thus, the rigid polymeric or lightweight metallic material surrounding the latching groove can be machined or molded and retain the precise geometry required on repeated latching to retain long term stability and reliability.

It is therefore an object of the present invention to provide predominantly paper yarn carriers which are made reusable by facilitating the cleaning of the starting groove.

It is another object of the present invention to provide a predominantly paper yarn carrier of the type described in which an end cap is releasably attached to the main body portion and forms a starting groove therebetween.

It is another object of the present invention to provide a yarn carrier of the type described in which the outer surface of at least the hollow tube is paper and the attachment means for joining the two are polymeric or metallic inserts which underlie the paper portion. Other objects and a fuller understanding of the invention will become apparent upon reading the following detailed description of a preferred embodiment along with the accompanying drawings in which:

FIG. 1 is a perspective view illustrating a yarn package wound on a winding tube made in accordance with the present invention;

FIG. 2 is a side view, with parts broken away, illustrating the winding tube of the present invention;

FIG. 3 is an enlarged sectional view taken diametrically through one end of the yarn carrier of FIG. 2 and illustrating a preferred embodiment of the invention;

FIG. 4 is a greatly enlarged sectional view of the end cap of FIG. 3 removed from the cylindrical portion of the winding tube.

DETAILED DESCRIPTION OF A PREFERRED EMBODIMENT

Figure 5:
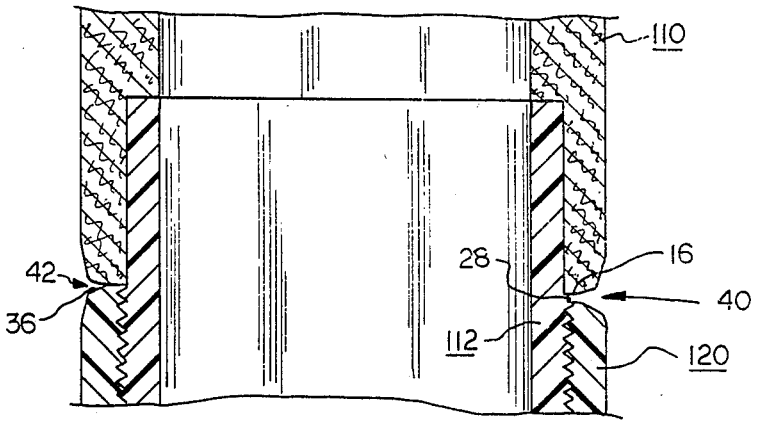
FIG. 5 is a view similar to FIG. 3, except showing an alternate embodiment of the end cap.

Turning now to the drawings, and particularly to FIG. 1, there is illustrated a yarn package formed in accordance with conventional automatic winding techniques. The yarn package includes a winding tube WT about which thousands of turns of yarn Y are wrapped. The winding tube WT is formed of at least two parts, i.e. the cylindrical hollow tube 10 and at least one end cap 20. A starting groove extending around the periphery is formed between the hollow tube 10 and releasable end cap 20. As the yarn package is initially formed, a relatively small number of turns of the yarn are guided into the starting groove where they are locked and form the waste bunch (WB). The length of yarn extending between the waste bunch and the yarn package Y is referred hereinafter as the transfer tail TT.

An empty winding tube WT is initially emplaced on the spindle (not shown) of a winding machine ready to have yarn wound thereupon. During the automatic winding operation of polyester or any other extruded polymeric yarn thereon, a vacuum hose is receiving the continuous extrusion of polyester or other polymeric yarn filament through a spinneret awaiting the emplacement of the winding tube. The vacuum hose is then held near the bottom periphery of the winding tube WT while a hand-held wire instrument is used by the operator to lift or move the yarn filament into contact with the starting groove. As the yarn is guided into the starting groove, it latches up and breaks from the remainder of the yarn being carried away by the vacuum hose. After the break occurs, rotation of the winding tube causes a few turns to form a waste bunch in the starting groove. The waste bunch includes approximately one hundred or more turns. Formation of the waste bunch functions to lock the leading end of the yarn tail as well as to maintain the "off-spec" yarn out of the yarn package while the speed of the yarn being extruded and the rotation of the tube is stabilized. After the waste bunch is completed, the winder goes into a normal wind cycle with the yarn being wrapped around the main body of the hollow tube 10. Once the yarn package is emptied, the winding tube WT must either be discarded, or else the starting groove in which the waste bunch is wound must be cleaned of remaining fibers. While in conventional winding techniques, for all practical purposes the starting groove of a paper tube cannot be cleaned, in the present invention such cleaning is made possible and even facilitated.

Thus, in the present invention, once the winding tube WT is emptied, the end cap 20 is loosened from the hollow tube 10 (FIG. 2), whereupon the remaining fragments, filaments, or fibers of the waste bunch may be easily vacuumed or stripped away. The end cap 20 is then tightened, and the yarn carrier WT is ready for reuse.

As earlier described, the starting groove may not necessarily extend around the entire periphery of the winding tube WT. For example, a starting groove may operate satisfactorily that only extends one-half or even one-quarter of the way around the periphery. This allows the first several turns of the transfer tail to enter and be locked therein. The remaining portion of the interface between the end cap 20 and winding tube 10 then merely engage and abut with essentially no groove therebetween other than perhaps a trough for the waste bunch.

Turning now to FIG. 2 there is illustrated an empty winding tube WT. A hollow cylindrical tube 10 is provided with a releasable end cap 20 on at least one end thereof. The periphery of tube 10 and end cap 20 are substantially coextensive. As illustrated in FIG. 2, a second end cap 20 may be releasably attached to the opposite end, in which case the life expectancy of the tube may be extended, and either end of the tube may serve to accumulate the waste bunch. However, it is felt that a quite satisfactory, long lasting winding tube WT can be fabricated which includes the end cap 20 on one end alone. The hollow tube 10 is formed predominantly of laminated paper or cardboard. An annular threaded insert or first ring 12 is attached to the end portion of hollow tube 10 as shown in FIG. 3. Insert 12 is formed of a more permanent material such as polymers selected from the group containing polycarbonate, PBT, PVC, ABS, polytetraphthalate, glass filled polymers, and carbon filled polymers. The inserts may even be formed of aluminum, magnesium, or some other lightweight metallic material. The end caps 20 (illustrated in FIG. 4) include an outer cylindrical laminated paper member 21 substantially coextensive with the outer surface of tube 10. A second insert or ring 22 is bonded or secured to the inner surface of the paper member 21 extends around the end thereof (FIG. 3), and is formed of one of the same materials as the first insert or ring 12.

Looking at FIGS. 3 and 4, the relationship between the end cap 20 and hollow tube 10 as designed for use with all but finer denier yarns is best shown as a result of the enlarged illustrations. The hollow tube 10 includes a marginal or terminal portion 11 having reduced wall thickness. The insert 12 includes internal threads 14 extending peripherally around the interior wall thereof and a radially extending nose portion 17. Nose portion 17 terminates in an end wall 16. A tapered or chamfered surface 18 joins the outer periphery of nose piece 17 and the end wall 16 to guide yarn being wrapped around hollow tube 10 in the area of the end portion thereof inwardly toward the peripheral groove portions 40, 42. A seat or counterbore 15 is formed in the inner surface of hollow tube 10 adjacent the terminal end thereof. Insert 12 is secured within seat 15 by a suitable adhesive such as methylene chloride. The seat may be formed by securing a shorter length inner tube 11 and a longer outer tube 12 in a concentric manner or by machining a counterbore in a paper tube.

The end cap 20 includes an outer cylindrical laminated paper member 21 with an axially extending second insert 22 of reduced wall thickness and having outer threads 24 around the periphery thereof which mate with and engage the inner threads 14 of first insert 12. The mating threads 14,24 form a means for releasably mounting the end cap 20 onto the hollow tube 10. Alternate mounting means might include snap fits or bayonet tabs or the like, it being understood that the mating threads 14,24 are representative thereof. In this regard, however, it is important that the connection between the end cap 20 and hollow tube 10 be secure and tight, so as to properly form the starting groove.

A groove forming, peripheral projection 25 is formed integrally with and extends radially from the periphery of insert 22. Projection 25 is formed from a rigid, incompressible material best suited to form the wall confronting the starting groove. Immediately adjacent the base of threads 24 on end cap 20 is a radially extending peripheral rim 26 formed in projection 25 around the inner periphery thereof, which forms a stop means against which the end wall 16 of the hollow tube 10 engages as the end cap is mounted on the hollow tube 10. The marginal or end portion 12 of hollow tube 10 is longer than the distance between the end of insert 22 and rim 26, so that the end wall 16 will engage peripheral rim 26 prior to the time the terminal wall 23 of the end cap 20 engages the corresponding portion of hollow tube 10.

A shoulder 28 extends around approximately three-fourths of the periphery of the end cap 20 (approximately 270°) and separates the peripheral rim 26 from a second or groove forming radial wall 30. The shoulder 28 maintains a separation (approximately 0.022 inches) between the end wall 16 of hollow tube 10 and the second groove forming wall 30 which separation is substantially greater than the diameter of the yarn being wound thereon. The separation between end wall 16 and wall 30 forms the lead-in position 40 of the starting groove. A bevelled surface or first chamber 32 (approximately 45°) angles outwardly from the groove forming wall 30 toward the outer periphery of the end cap 20.

Finally a slight chamfer 34 connects the outer periphery of end cap 20 with the first chamfer 32.

In the remaining one-fourth (approximately 90°) of the periphery of the end cap, the shoulder 28 and groove forming wall 30 is replaced by the slightly angled peripheral rim 36 which, with end wall 16, for the locking portion 42. Rim 36 does not extend radially, rather is tapered away from an imaginary radius by an angle of approximately 5° 30 min. Again the second rim 36 is connected to the outer periphery of end cap 20 by a chamfered surface 34. Chamfered surfaces 18 and 34 cooperate to form a trough in which the waste bunch is collected.

Where the yarn carrier is intended for use with finer denier yarns that do not require the lead-in portion 40, the construction of the end cap and hollow tube which form the starting groove are so constructed as to continue the locking portion 42 around the entire periphery. Thus the lead-in portion 40 is eliminated and the starting groove takes on the configuration of the locking groove 42.

In another alternate embodiment (FIG. 5), the end cap is all polymeric, at least the surface of which is formed of a wear resistant material that is capable of withstanding the frictional forces exerted by the drive wheels against the surface thereof without damage thereto. For some reason, paper can resist these forces with only minimal damage, but most polymers exhibit unacceptably high wear. One example of a polymer which apparently exhibits the necessary wear characteristics is high density, ultra high molecular weight polyethylene having an average molecular weight of 3.54 million as measured by the light scattering method. In this embodiment, the end cap 120 includes internal threads and the hollow tube 110 includes an insert 112 that extends axially beyond the tube, is externally threaded, and is received within end cap 120. This construction is extremely efficient.

Thus formed, there is a transfer groove means formed between the abutting ends of the hollow tube and the end cap which encircles the yarn carrier. For all but finer denier yarns, the groove means includes first a relatively wide lead-in portion 40 which is formed by shoulder 28. Secondly a relatively narrow locking portion 42 is formed between the abutting end 16 of hollow tube 10 and the second peripheral rim 36 of end cap 26. So arranged, the yarns of the waste bunch are directed toward the lead-in portion 40 and into the locking portion 42 as the winding tube is rotated.

When the yarn package is emptied, yarn fibers and filaments tend to remain in the lead-in portion 40 and the locking portion 42. Such yarn ends cannot be vacuumed or stripped away in conventional, integrally formed paper tubes. However, the present construction allows provides a predominantly paper tube in which an operator may release and move the end cap in an axial direction away from the end of the winding tube, whereupon the fibers and filaments are released and can be easily removed by suction or other stripping techniques. As described hereinabove, the end cap surface treatment is necessary only for use on winding equipment that includes a drive mechanism that engages the end of the winding tube that contains the end cap. Where the intended winding equipment engages only the take-off end of the yarn carrier, the end cap 20 can be all polymeric or metallic without need for a wear-resistant surface.

As suggested earlier, the separable end cap and starting groove configuration may appear at both ends of the winding tube, if desired. While the invention has been described in detail hereinabove, it is obvious that various changes and modifications might be made without departing from the scope of the invention which is set forth in the accompanying claims, in which:

What is claimed is:

1. A reusable yarn carrier comprising:

(a) a composite hollow tube having an outer, substantially cylindrical laminated paper surface adapted to carry a fibrous or filamentary yarn thereon, an annular, first insert secured to the end portion of the inner surface of said hollow tube, said insert being formed of a rigid, incompressible material relative to said paper;

(b) a separable end cap having an outer cylindrical surface;

(c) threaded attachment means joining said first insert and a portion of said end cap for releasably mounting said end cap on at least one end of said hollow tube;

(d) confronting walls of said tube and end cap, when assembled, cooperating to define a starting groove therebetween which groove receives and locks the first few turns of yarn of a waste bunch therein as winding is commenced;

(e) whereby said yarn carrier is predominantly paper, yet includes rigid confronting walls between said tube and end cap and permit, when separated, the loosening of trapped fibers and facilitate cleaning and reuse.

2. The reusable yarn carrier according to claim 1, wherein the outer cylindrical surface of said end cap is formed of a wear resistant material that can withstand the forces exerted by a surface drive mechanism of automatic winding machines.

3. The yarn carrier according to claim 1 wherein the outer cylindrical portion of said end cap is laminated paper and a second insert is secured to the inner surface thereof.

4. The yarn carrier according to claim 1 wherein said threads are formed internally of said first insert and externally of said end cap.

5. The yarn carrier according to claim 1 wherein said first insert and at least the threaded portion of said end cap are formed of a polymeric material.

6. The yarn carrier according to claim 5 wherein said polymeric material is polycarbonate.

7. The yarn carrier according to claim 1 wherein said first insert and at least the threaded portion of said end cap are formed of a metallic material selected from the group consisting of aluminum and magnesium.

8. The yarn carrier according to claim 1 wherein one of said end caps is provided on each end of said hollow tube.

9. The yarn carrier according to claim 1 wherein said locking portion is formed by at least one of the abutting walls of said hollow tube and said end cap being tapered from an imaginary radius.

10. The yarn carrier according to claim 9 wherein a first peripheral chamfered surface connects the outer peripheral surface of said hollow tube and the end wall thereof and a second peripheral chamfered surface connects the outer cylindrical surface of said end cap with the end wall thereof, said first and second chamfered surfaces form a trough, when said tube and end cap are assembled, in which said waste bunch is collected.

11. The yarn carrier according to claim 1 wherein said end cap is all polymeric material.

12. The yarn carrier according to claim 11 wherein said polymeric material is ultra high molecular weight polyethylene.

* * * * *